US007305796B2

(12) United States Patent
Chiang

(10) Patent No.: US 7,305,796 B2
(45) Date of Patent: Dec. 11, 2007

(54) DOOR-CLOSING ASSEMBLY

(76) Inventor: Fanny Chiang, 11 F1. -4, No. 16, Chungming S. Rd., West Dist., Taichung (TW)

( * ) Notice: Subject to any disclaimer, the term of this patent is extended or adjusted under 35 U.S.C. 154(b) by 68 days.

(21) Appl. No.: 11/393,746

(22) Filed: Mar. 31, 2006

(65) Prior Publication Data

US 2007/0246945 A1 Oct. 25, 2007

(51) Int. Cl.
*E05D 7/08* (2006.01)
*E05D 7/12* (2006.01)

(52) U.S. Cl. ..... 49/388; 16/252; 16/255

(58) Field of Classification Search ..... 292/92, 292/DIG. 4, DIG. 15, DIG. 17, DIG. 61; 16/72, 255, 280, 281, 284, 378, 379; 49/236, 49/237, 239, 388
See application file for complete search history.

(56) References Cited

U.S. PATENT DOCUMENTS 987,467 A * 3/1911 Katzenberger ..... 16/281
1,122,322 A * 12/1914 Smith ..... 16/292
1,653,448 A * 12/1927 Bommer ..... 16/284
2,035,823 A * 3/1936 Moore ..... 16/284
2,078,303 A * 4/1937 Zetmeir ..... 16/280
5,867,869 A * 2/1999 Garrett et al. ..... 16/252
5,867,871 A * 2/1999 Tasman ..... 16/335
6,161,255 A * 12/2000 Garrett ..... 16/284
6,526,627 B2 * 3/2003 Chiang ..... 16/284
6,966,150 B2 * 11/2005 Chiang ..... 49/388
7,127,777 B2 * 10/2006 Chiang ..... 16/252

* cited by examiner

*Primary Examiner*—Carlos Lugo
(74) *Attorney, Agent, or Firm*—Rabin & Berdo, P.C.

(57) ABSTRACT

A door-closing assembly is used on a door and has a body, a drive device and a fastening device. The body is mounted on the door and has a connecting element, a longitudinal hole and a threaded hole. The longitudinal hole is defined in the bottom near the proximal end of the body. The threaded hole is formed in the body at the distal end and communicates with the longitudinal hole. The drive device is mounted in the body and has a mounting pillar, a jacket, a holding head and a spring. The mounting pillar is held inside the longitudinal hole. The jacket is slidably held inside the threaded hole and contacts with the mounting pillar. The holding head is screwed in the threaded hole. The spring is held between the jacket and the holding head. The fastening device is connected with the mounting pillar and has a bottom board.

8 Claims, 5 Drawing Sheets

DOOR-CLOSING ASSEMBLY

BACKGROUND OF THE INVENTION

1. Field of the Invention

The present invention relates to a door-closing assembly, and more particularly relates to a door-closing assembly used to close a door automatically and manufactured and assembled quickly and conveniently.

2. Description of Related Art

In general, a door can be made of glass, timber or metals and a user should apply a force to keep the door at an open condition. In addition, the user opens or closes a door manually, so to open or to close a door is inconvenient especially when the user holds something with hands.

Therefore, the invention provides a door-closing assembly to mitigate or obviate the aforementioned problems.

SUMMARY OF THE INVENTION

The main objective of the present invention is to provide a door-closing assembly for a door and that can close the door automatically and is manufactured and assembled quickly and conveniently.

The door-closing assembly is used on a door and comprises a body, a drive device and a fastening device. The body is mounted on the door and has a connecting element, a longitudinal hole and a threaded hole. The longitudinal hole is defined in the bottom near the proximal end of the body. The threaded hole is formed in the body at the distal end and communicates with the longitudinal hole. The drive device is mounted in the body and has a mounting pillar, a jacket, a holding head and a spring. The mounting pillar is rotatably held inside the longitudinal hole. The jacket is slidably held inside the threaded hole and contacts with the mounting pillar. The holding head is screwed in the threaded hole. The spring is held between the jacket and the holding head. The fastening device is connected with the mounting pillar and has a bottom board.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
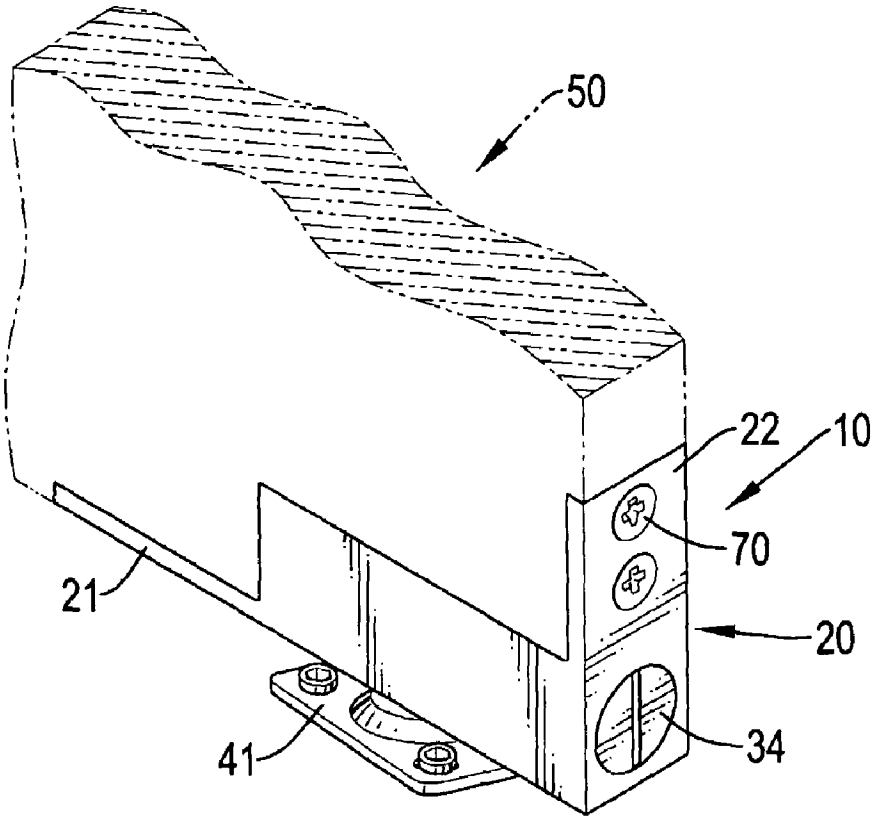
FIG. 1 is a perspective view of a door with a door-closing assembly in accordance with the present invention and mounted on a door.
Figure 2:
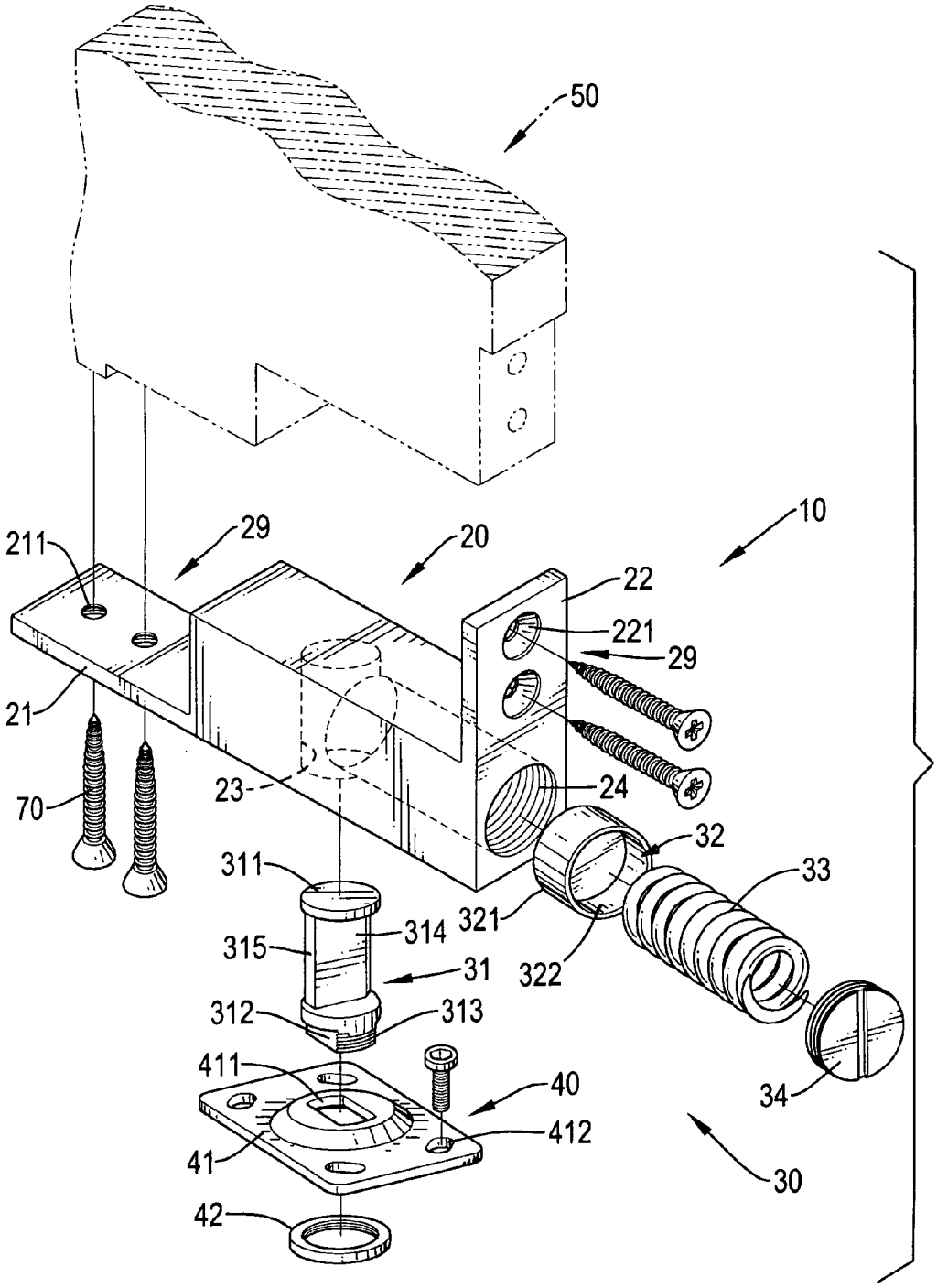
FIG. 2 is an exploded perspective view of the door with the door-closing assembly in FIG. 1.
Figure 3:
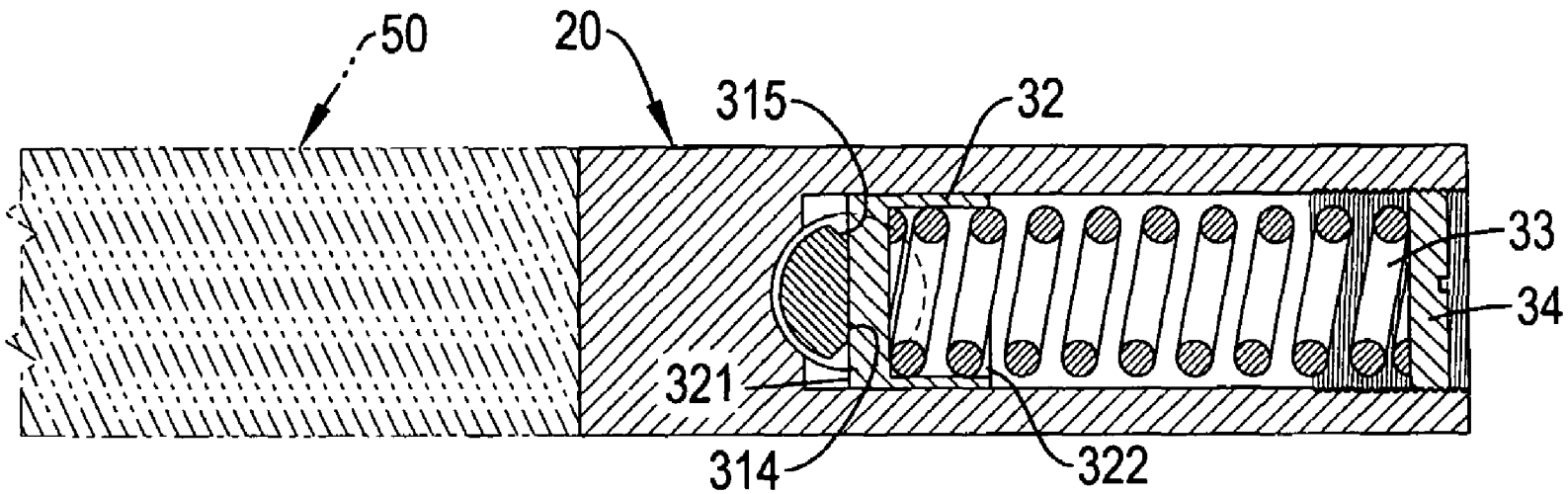
FIG. 3 is a cross sectional top view of the door with the door-closing assembly that in FIG. 1.

With reference to FIGS. 1 to 3, a closing assembly (10) in accordance with the present invention is used on a door (50) having a top, a bottom and a side surface, and comprises a body (20), a drive device (30) and a fastening device (40).

The body (20) is mounted on the bottom of the door (50) and has a proximal end, a distal end, a top, a bottom, a connecting element (29), a longitudinal hole (23) and a threaded hole (24). The connecting element (29) is mounted with the body (20) and has a connecting bottom board (21) and a connecting side board (22). The connecting bottom board (21) is extended from the proximal end of the body (20), is attached to the bottom of the door (50) and has multiple connecting holes (211). The connecting side board (22) is extended from the distal end of the body (20), is attached to the side surface near the bottom of the door (50) and has multiple connecting holes (221). The longitudinal hole (23) is defined in the bottom near the proximal end of the body (20). The threaded hole (24) is laterally formed in the distal end of the body (20) and communicates with the longitudinal hole (23).

The drive device (30) is mounted in the body (20) and has a mounting pillar (31), a jacket (32), a holding head (34) and a spring (33). The mounting pillar (31) is semicircle-shaped, is rotatably held inside the longitudinal hole (23) and has an upper end, a lower end, a slab (311), a mounting block (312), a thread (313), a resisting surface (314) and two returning surfaces (315). The slab (311) is circular-shaped, is formed on the upper end of the mounting pillar (31) and extends into the longitudinal hole (23). The mounting block (312) is mounted in the lower end of the mounting pillar (31) and has two curve sides opposite to each other. The thread (313) is formed on the curve sides of the mounting block (312). The resisting surface (314) is formed on the mounting pillar (31) between the slab (311) and the mounting block (312) and has two sides. The returning surfaces (315) are respectively formed inclinedly on the sides of the resisting surface (314) between the slab (311) and the mounting block (312).

The jacket (32) is hollow, is slidably held inside the threaded hole (24) in the body (20) contacts with resisting surface (314) on the mounting pillar (31) and has a close end (321), a open end (322) and a cavity. The close end (321) selectively abuts against the resisting surface (314) or one of the returning surfaces (315). The cavity is formed in the jacket (32) through the open end (322).

The holding head (34) is screwed into the threaded hole (24) at the distal end of the body (20). The spring (33) is held inside the threaded hole (24) between the cavity of the jacket (32) and the holding head (34).

The fastening device (40) is connected with the mounting pillar (31), is secured to the ground and has a bottom board (41) and a fastening ring (42). The bottom board (41) is rectangle-shaped, is secured to the ground, is engaged with the mounting block (312) and has a center, a mounting hole (411) and multiple circular holes (412). The mounting hole (411) is formed in the center through the bottom board (41) and is engaged with the mounting block (312). The circular holes (412) are formed through the bottom board (41) around the mounting hole (411). The mounting block (312) is engaged with and extends through the mounting hole (411), and the thread (313) on the mounting block (312) is engaged with the fastening ring (42).

With reference to FIG. 2, to assemble the door-closing assembly (10) to a door (50), multiple screws (70) are extended through the connecting holes (211,221) and are screwed into the door (50). Then, the bottom board (41) is secured onto the ground with multiple bolts, and the mounting pillar (31) is inserted into the longitudinal hole (23) and is engaged with the mounting hole (411) with mounting block the (312) to serve as a pivotal pin of the door (50). The jacket (32) and the spring (33) are held in the threaded hole (24) between the mounting pillar (31) and the holding head (34) as shown in FIG. 1.

Figure 4:
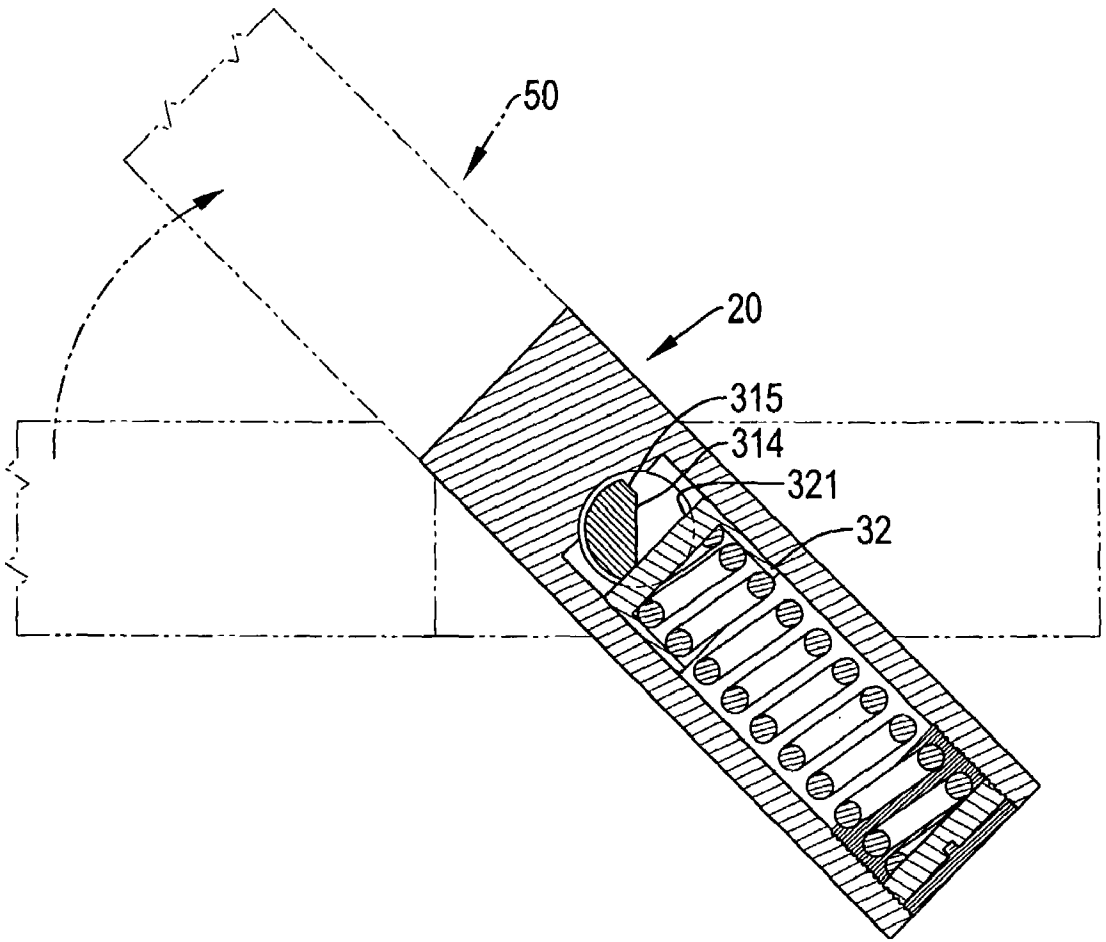
FIG. 4 is an operational top view in partial section of the door with the door-closing assembly that in FIG. 1.
Figure 5:
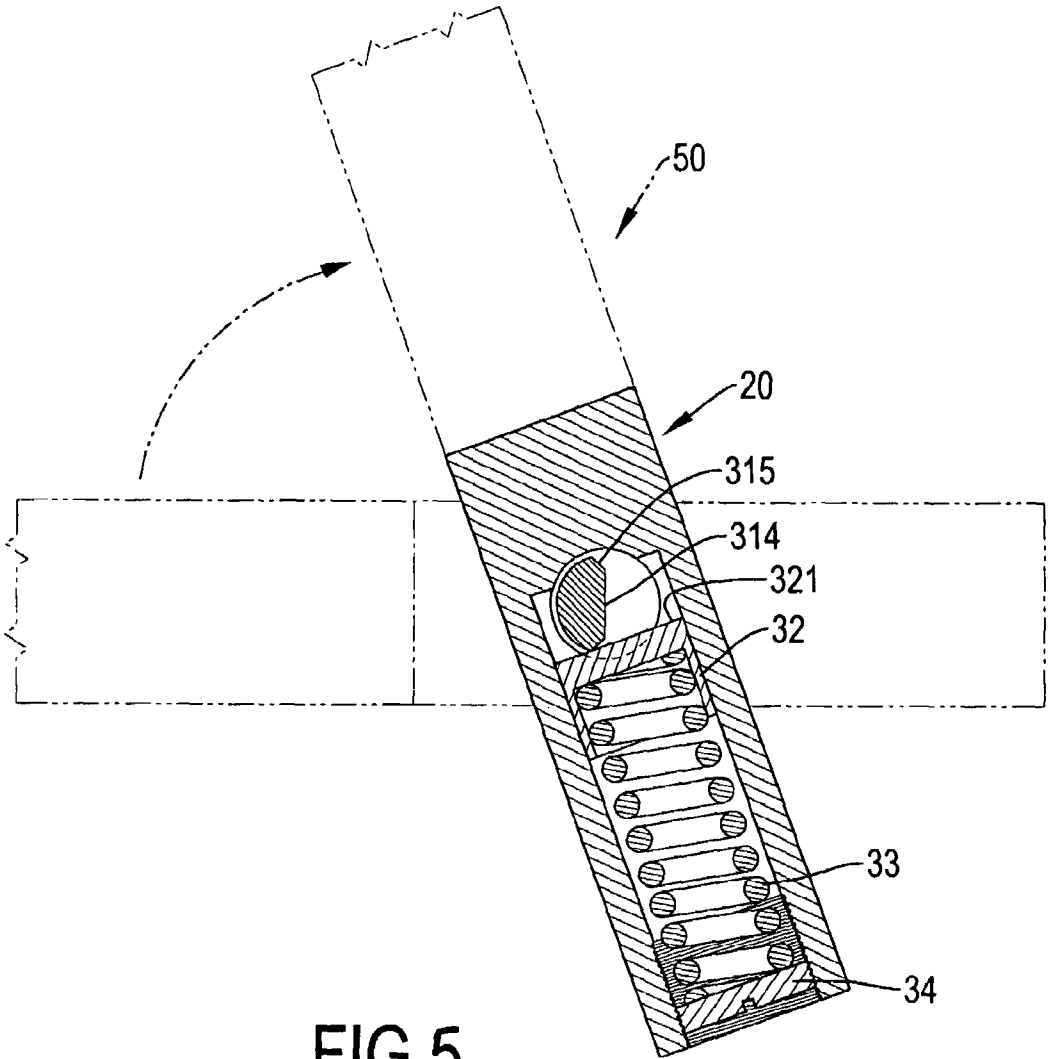
FIG. 5 is another operational top view in partial section of the door with the door-closing assembly that in FIG. 1.

With reference to the FIGS. 4 and 5, when to the door (50) is opened, the body (20) is moved with the door (50) and pivots relative to the mounting pillar (31). Then, the close end (321) of the jacket (32) will contact against one of the returning surfaces (315). The distance between the returning surface (315) and the holding head (34) is shorter than the distance between the resisting surface (314) and the holding head (34), so the spring (33) is compressed between the jacket (32) and the holding head (34) when the close end (321) abuts against one of the returning surfaces (315). Then, when user releases the force applied onto the door (50), the door-closing assembly (10) will pivot the door (50) to the original location with the recoil force provided by the spring (32) and pushing the close end (321) of the jacket (32) to contact with the resisting surface (314).

The door-closing assembly (10) in accordance with the present invention has the following advantages:

1. The door-closing assembly (10) can close the door (50) automatically by means of the recoil force provided by the spring (32) for pushing the close end (321) of the jacket (32) to abut against the resisting surface (314). Therefore, to close the door is convenient even when hands of a user are not free.

2. To assemble the door-closing assembly (10) onto a door (50) is easy, and the door-closing assembly (10) is convenient in manufacturing.

3. The door-closing assembly (10) can be used on a glass door, a timber door or a metal door and is versatile in use.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A door-closing assembly used on a door that is capable of being open in two opposite direction and having a top, a bottom and a side surface, and the closing assembly having a body adapted to be mounted on the bottom of the door and having a proximal end;

a distal end;

a top;

a bottom;

a connecting element mounted on the body;

a longitudinal hole defined in the bottom near the proximal end of the body; and a threaded hole laterally formed in the body at the distal end and communicating with the longitudinal hole;

a drive device mounted in the body and having a mounting pillar being semicircle-shaped, rotatably held inside the longitudinal hole and having an upper end;

a lower end;

a slab being circular-shaped, formed on the upper end of the mounting pillar and held inside the longitudinal hole;

a mounting block mounted on the lower end of the mounting pillar;

a resisting surface formed on the mounting pillar between the slab and the mounting block and having two sides; and two planar returning surfaces respectively formed inclinedly on the sides of the resisting surface between the slab and the mounting block;

a jacket being hollow, slidably held inside the threaded hole in the body and contacting with the mounting pillar;

a holding head screwed into the threaded hole at the distal end of the body; and a spring held in the threaded hole between the jacket and the holding head; and a fastening device connected with the mounting pillar and having a bottom board engaged with the mounting block and having a center; and a mounting hole formed in the center through the bottom board and securely engaged with the mounting block.

2. The door-closing assembly as claimed in claim 1, wherein the connecting element has a connecting bottom board extending from the proximal end of the body, adapted to be attached to the bottom of the door and having multiple connecting holes; and a connecting side board extending from the distal end of the body, adapted to be attached to the side surface the door and having multiple connecting holes.

3. The door-closing assembly as claimed in claim 2, wherein the jacket has a close end selectively abutting against one of the resisting surface and the returning surfaces;

an open end; and a cavity formed in the jacket through the open end to hold one end of the spring inside the cavity.

4. The door-closing assembly as claimed in claim 3, wherein the bottom board is rectangle-shaped and further has multiple circular holes forming through the bottom board around the mounting hole.

5. The door-closing assembly as claimed in claim 4, wherein the mounting block has two curve sides opposite to each other, and a thread is formed on the curve sides of the mounting block; and the fastening device has a fastening ring engaging with the thread on the mounting block.

6. The door-closing assembly as claimed in claim 1, wherein the jacket has a close end selectively abutting against one of the resisting surface and the returning surfaces;

an open end; and a cavity formed in the jacket through the open end to hold one end of the spring inside the cavity.

7. The door-closing assembly as claimed in claim 1, wherein the bottom board is rectangle-shaped and has multiple circular holes forming through the bottom board around the mounting hole.

8. The door-closing assembly as claimed in claim 1, wherein the mounting block has two curve sides opposite to each other, and a thread is formed on the curve sides of the mounting block; and the fastening device has a fastening ring engaging with the thread on the mounting block.

* * * * *